United States Patent [19]

Southworth

[11] Patent Number: 4,669,991

[45] Date of Patent: Jun. 2, 1987

[54] SWIMMING GLOVE

[76] Inventor: George W. Southworth, 9200 Westminster Ave. #64, Westminster, Calif. 92683

[21] Appl. No.: 846,718

[22] Filed: Apr. 1, 1986

[51] Int. Cl.[4] ..... A63B 31/02

[52] U.S. Cl. ..... 441/57; D21/239

[58] Field of Search ..... 441/56, 57, 58; D21/237, 238, 239

[56] References Cited

U.S. PATENT DOCUMENTS

| | | | |
|---|---|---|---|
| 1,008,117 | 11/1911 | Copeland et al. | 441/57 |
| 1,093,276 | 4/1914 | Laser | 441/57 |
| 1,625,730 | 4/1927 | Lake | 441/57 |
| 1,740,290 | 12/1929 | Feketis | 441/57 |
| 1,746,268 | 2/1930 | Lepetich | 441/57 |
| 1,748,317 | 2/1930 | Sykes | 441/57 |
| 1,773,440 | 8/1930 | Sbrolla | 441/57 |
| 1,777,050 | 9/1930 | Quain | 441/57 |
| 1,888,867 | 11/1932 | Schmitt | 441/57 |
| 2,004,684 | 6/1935 | Bell | 441/57 |
| 2,016,538 | 10/1935 | Borgman | 441/57 |
| 2,324,375 | 7/1943 | Eslick | 441/57 |
| 2,704,372 | 3/1955 | Criger | 441/57 |
| 4,121,312 | 10/1978 | Penny | 441/57 |

FOREIGN PATENT DOCUMENTS

| | | | |
|---|---|---|---|
| 338019 | 11/1930 | United Kingdom | 441/57 |

*Primary Examiner*—Joseph F. Peters, Jr.
*Assistant Examiner*—Thomas J. Brahan
*Attorney, Agent, or Firm*—Frank C. Price

[57] ABSTRACT

A glove for the hand to augment propulsion in swimming is made with webs which readily collapse for streamlining in the return movement of the arm after a power stroke. Bare finger tips protrude for dexterity. The glove is configured for mass production by machines making straight cuts and stitches.

1 Claim, 4 Drawing Figures

SWIMMING GLOVE

References Cited

U.S. Patent Documents
U.S. Pat. No. 1,740,290, 12/29 Feketis
U.S. Pat. No. 1,746,268, 2/30 Lepetich
U.S. Pat. No. 1,748,317, 2/30 Sykes
U.S. Pat. No. 1,773,440, 8/30 Sbrolla
U.S. Pat. No. 1,777,050, 9/30 Quain
U.S. Pat. No. 1,888,867, 11/32 Schmitt
U.S. Pat. No. 2,004,684, 6/35 Bell
U.S. Pat. No. 2,016,538, 10/35 Borgman
U.S. Pat. No. 4,121,312, 10/78 Penny

BACKGROUND

This is the invention of a glove for the hand of a swimmer to enhance his propulsion. There are many areas of sports such as surfing, snorkeling, scubba diving and wind surfing where enhanced swimmer propulsion is desireable. The same is true for industrial work in water such as around drilling rigs or where ship hulls or docks are worked on from beneath the water surface.

Many versions of gloves for enhanced water propulsion have been invented. The object has usually been to increase the "bite" of the water taken by the hand. The problems have been in avoiding the loss of dexterity imposed by a glove, giving the glove floatation, making the glove streamlined for the recovery stroke of paddling, providing good attachment to the hand, and creating a maximum "bite" with the design. As with any product, ease of manufacture at minimum cost is always important.

SUMMARY OF THE INVENTION

The best way to describe this invention is to describe the steps in its construction. The glove consists of a top part, a bottom part, a velstrap, and non-stretchable thread. The top and bottom parts, the main body of the glove, can be made of foamed, closed-cell neoprene laminated with nylon fabric on both sides to provide maximum flexibility and strength. The steps in constructing a glove are as follows:

Step 1: The top and bottom parts are die cut.

Step 2: The top and bottom parts are superimposed as an inside-out glove. The edges of the main body are sewn with stretchable stitching to create flexibility.

Step 3: The spaces between where the fingers lie are stitched to form the spaces for the fingers and to form the webbing. The ends of the fingers are left open.

Step 4: The webbing between the thumb and the forefinger is sewn shut along the edge. This double thickness and its thread makes a stiff web for working against the water.

Step 5: The webbing of the top piece is cut away between the fingers. The remaining single layer of webbing provides flexibility movement of the fingers.

Step 6: The Velcro strap is then sewn into place at the wrist.

The glove resists water intrustion to the hand, which would be a burden to the paddling action. The glove, in the way it fits the hand, induces minimum drag as the arm is retracted after a power stroke.

DESCRIPTION OF THE PREFERRED EMBODIMENT

SUMMARY OF THE DRAWINGS

Included in the two views are the details of the glove stitching, cutouts for the digits, and the Velcro wrist strap. FIG. 2 contains a cutaway view to show the internal stitching along the sides of the hand. This is done with the layers inside-out.

DETAILED DESCRIPTION

Figure 1:
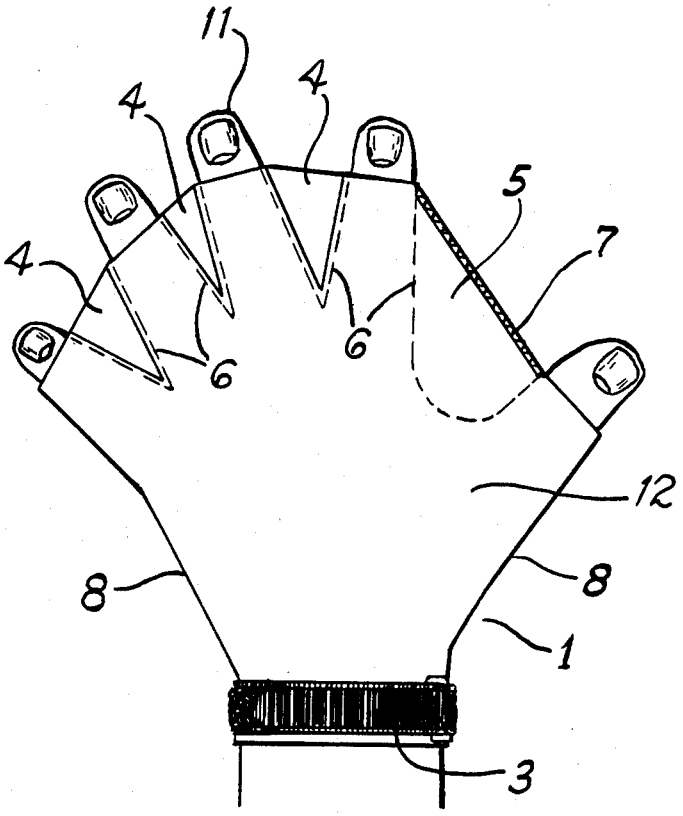
FIG. 1 shows the glove viewed on the back of the hand.

In FIG. 1, showing the back of the gloved hand, is seen the outline of a glove which is made of stretchable, laminated material including fabric backing on both sides of the laminate. While human finger tips 11 are shown to illustrate the worn glove, the glove shape is shown in its finished, fabricated form without a hand inserted. An important point is the straightline shape 8 of all except one of the material cuts and stitching which form the glove. This form allows faster, high volume production methods, while at the same time, with the use of stretchable material and stretchable stitching, the glove accomodates itself readily to the insertion of the hand.

Figure 3:
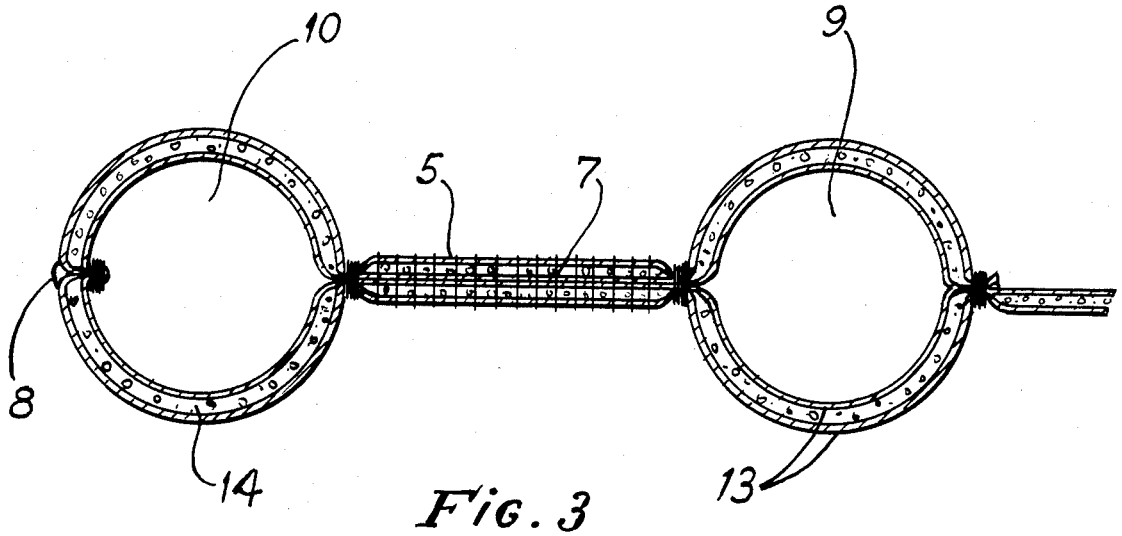
FIG. 3 shows an end cross section in the region of the thumb and the index finger tip.

The glove 1, FIG. 3, consists of a rubber-nylon laminate 12, creating the two sides of the glove which covers the hand and most of the fingers and the thumb, and, providing, as two laminate layers, stiffness in the web 5 between the thumb and the index finger. Other parts of the glove 1 are the web 4 between the fingers, which is single-layered laminate to allow the fingers to come together more easily, the Velcro wrist band 3 which helps hold the glove 1 onto the hand and keeps water from entering the inside of the glove, stretchable stitching 6, non-stretchable stitching 7 binding two laminate layers 5 between the thumb and index finger, and the curved, stretchable stitching 6 extending from the thumb to the index finger.

Figure 2:
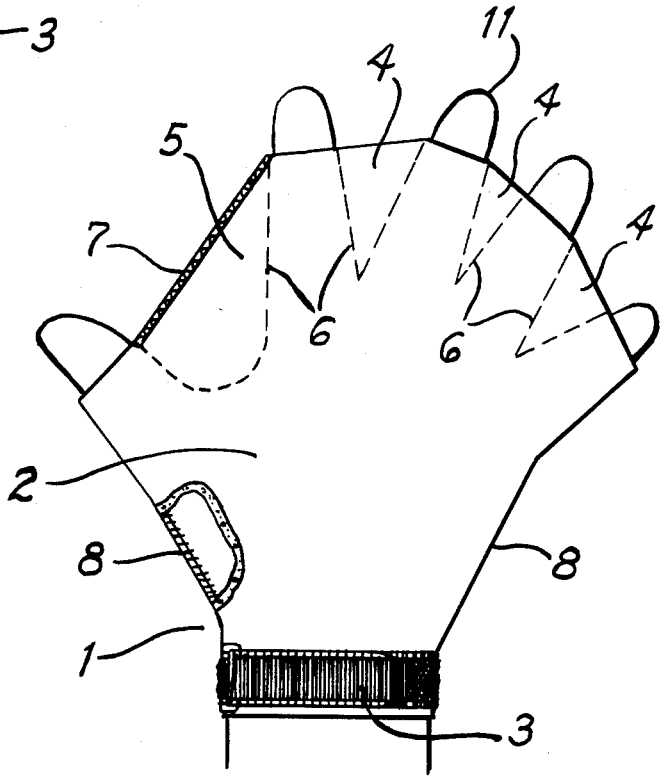
FIG. 2 shows the glove viewed on the palm of the hand.

FIG. 2, a view of the palm of the gloved hand, shows the second piece of material 2 which makes up the cover for the palm side of the hand and depicts the second piece of material 2 which is congruent with the first piece 12, except along the edges of the fingers between the fingers, this piece of material 2 has been removed leaving only a single layer 12 for the webs in those locations. Tne two pieces 2 and 12 are stitched together along the sides 8 of the hands, along the sides 6 of the fingers and along the contour 6 between the index finger and the thumb, and along the edge of the finger-thumb web 7.

FIG. 3 illustrates the cross section of the glove 1 in the region of the web between the thumb hole 10 and the index finger hole 9. The double layered web 5 between the thumb and index finger can be seen along with the non-stretchable stitching 7 which binds the edges of the two layers of material which form the web 5. The lamination of the fabric layers is shown, the central foam-rubber layer 14 and the two, outer fabric layers 13.

Figure 4:
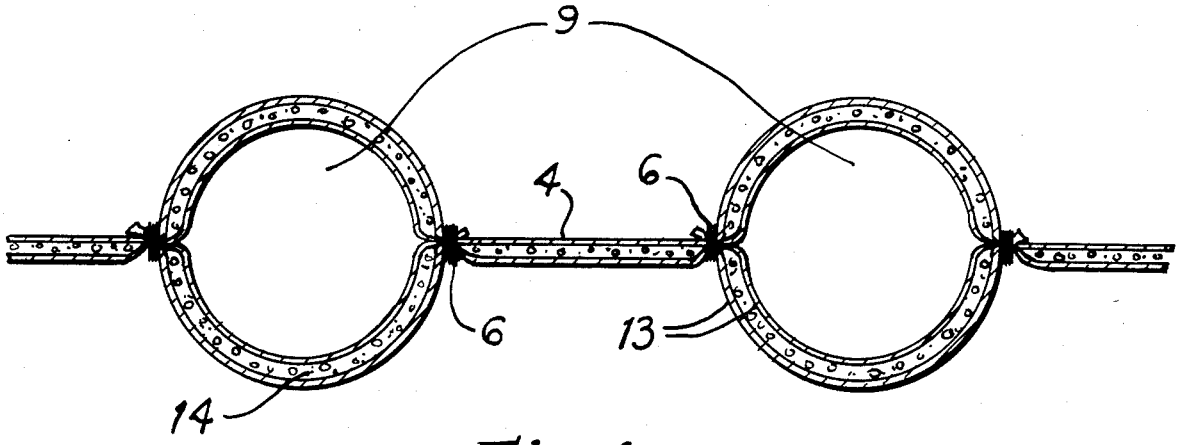
FIG. 4 shows an end cross section in the region of the finger tips.

FIG. 4 illustrates the cross section of the glove 1 in the web region between the fingers where the web 4 is only one layer 12. Also shown is the stitching 6 which proceeds along the regions which are formed to contain the fingers. The webs 4 are formed, as indicated above, as one layer by cutting away one of the thicknesses 2 of the glove 1 after the stitching 6 has been performed.

The resulting glove is one which is readily adaptable to efficient, high volume production with its straight line cuts and stitching. It is retained firmly on the active, paddling hand. It is streamlined for minimum drag through the water on the recovery stroke of the hand by virtue of its smooth, complete coverage of the hand and the absence of any tendency to scoop water into its interior. The exposed fingers enhance dexterity for any handwork performed by the wearer.

I claim:

1. A glove for the hand for use in water to enhance the stroking power of the hands in creating propulsion, the glove being made up of a covering extending from the finger tip joints of the fingers and the thumb, covering both sides of the hand and fingers, with webbing effects between the fingers and between the index finger and the thumb, with a wrist belt closing the glove to the wrist, the improvement comprising: two pieces of stretchable material, a first, single, piece of material being cut to a polygon shape, the perimeter being created by straight lines forming angles greater than eighty degrees; the second piece of material cut to superimpose on the perimeter of the first piece and so superimposed there; in addition, along the perimeter of the second piece there being three interior angles forming the shape of the spaces between the outstretched, spread fingers; stitching along the perimeter of the second piece to join the first and the second pieces along the interier angles of the second piece, non-stretchable stitching joining the two pieces of material along their edges which run between the index finger and the thumb, stretchable stitching along the sides of the inserted hand, the resulting construction being a flat glove made of stretchable material with the finger tips of an inserted hand protruding, a single layer of material forming webs between the fingers, and a double layer of material forming a web between the thumb and the index finger.

* * * * *